United States Patent [19]

Garfinkle

[11] Patent Number: 4,777,750

[45] Date of Patent: Oct. 18, 1988

[54] FRAME SYSTEM

[75] Inventor: Benjamin L. Garfinkle, Alameda, Calif.

[73] Assignee: Clamp Swing Pricing Co., Alameda, Calif.

[21] Appl. No.: 609,804

[22] Filed: May 14, 1984

[51] Int. Cl.[4] ..... G09F 15/00

[52] U.S. Cl. ..... 40/607; 40/606; 40/152.1

[58] Field of Search ..... 40/607, 606, 152.1, 40/584, 155, 16, 158 B, 152, 611, 10 R

[56] References Cited

U.S. PATENT DOCUMENTS

| | | | |
|---|---|---|---|
| 1,444,810 | 2/1923 | Swarts | 40/584 |
| 1,837,348 | 12/1931 | Ware | 40/152.1 |
| 1,857,423 | 5/1932 | Zadek | 40/152.1 |
| 1,888,565 | 11/1932 | O'Rourke | 40/152.1 |
| 1,912,643 | 6/1933 | Lewis | 40/152.1 |
| 2,070,652 | 2/1937 | Elmer | 40/16 |
| 2,285,176 | 6/1942 | Taylor . | |
| 2,501,176 | 3/1950 | Jacobs . | |
| 2,572,735 | 10/1951 | Kugel | 40/152 |
| 2,639,530 | 5/1953 | Merrill | 40/152 |
| 2,800,732 | 7/1957 | Duran . | |
| 2,827,722 | 3/1958 | Leclerc . | |
| 2,866,286 | 12/1958 | Hartman . | |
| 2,876,359 | 3/1959 | Plymate | 40/607 |
| 2,935,804 | 5/1960 | Duckro . | |
| 2,952,431 | 9/1960 | Pedley . | |
| 3,085,546 | 4/1963 | Pelletier | 40/607 |
| 3,722,121 | 3/1973 | Olczewski | 40/152 |
| 4,040,194 | 8/1977 | Penton et al. | 40/607 |
| 4,229,892 | 10/1980 | Hueter et al. | 40/152.1 |
| 4,329,800 | 5/1982 | Shuman | 40/607 |

*Primary Examiner*—Robert Peshock
*Assistant Examiner*—J. Hakomaki
*Attorney, Agent, or Firm*—Limbach, Limbach & Sutton

[57] ABSTRACT

A sign holder system comprising a display frame for displaying and supporting a sign, the frame being in two complementary halves which are connectible. Connections are also provided for attaching the display frame to a support structure. The connections in turn comprise an adaptor, which is intended to be located between the frame halves, which is, in turn, connected to a support for positioning the display frame in a chosen orientation.

1 Claim, 4 Drawing Sheets

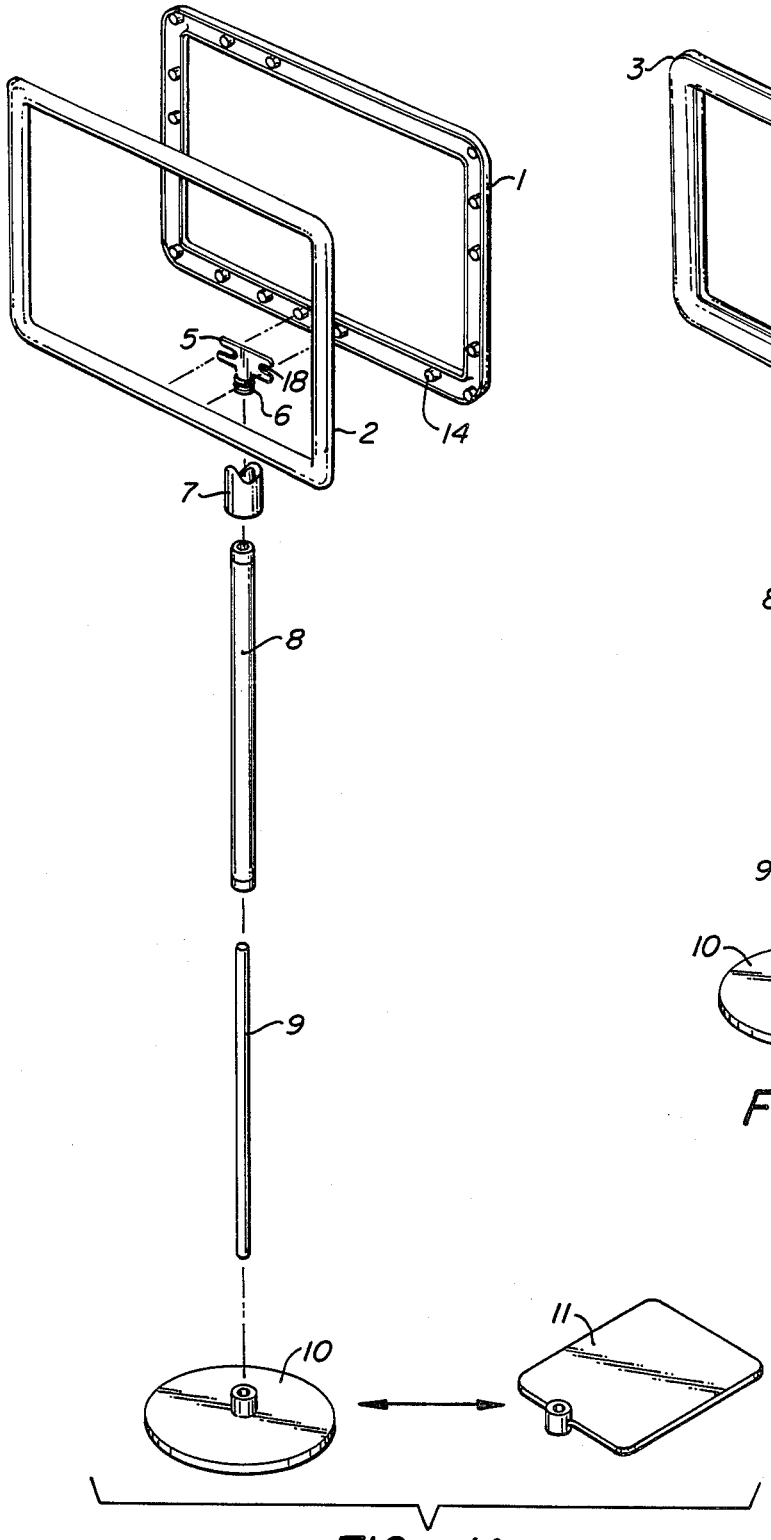
FIG._IA.
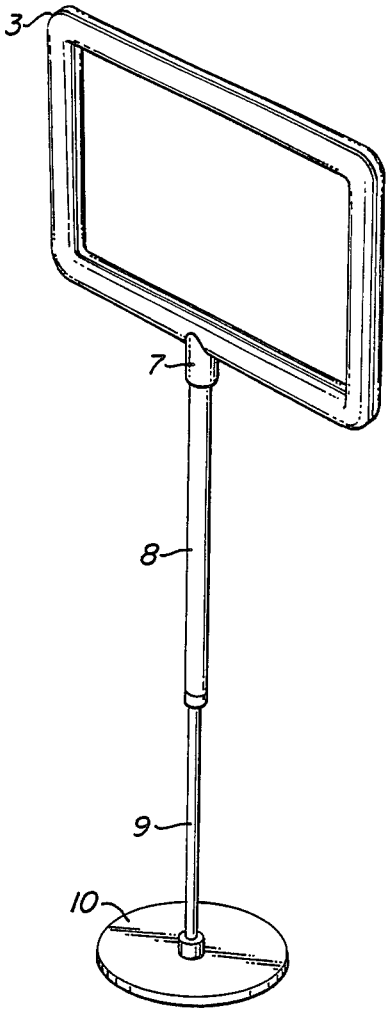
FIG._IB.

FRAME SYSTEM

DESCRIPTION

1. Technical Field of Invention

The present invention deals with a sign holder system whereby display frames of various sizes and orientations can be assembled on site, thus reducing the sign inventory which was heretofore necessary in providing adequate marketing flexibility.

2. Background of the Invention

In supermarkets, grocery stores and other environments where virtually each product must be identified by some type of sign, it has been common practice to provide metal sign holders which are fabricated in a single shape and size by their manufacturer. Although it has been common practice to employ such signs in a variety of display environments which require sign holders to have either a counter base, end/dump base, easel display base or hook attachments, etc., once the various sign holders have been constructed in each of the above categories, they can be used only in the manner intended by the manufacturer. In other words, if a sign display frame were to be connected to an easel base, for example, it could be used only where such a base was appropriate, and it would be impossible for the end user to interchange various bases at will.

The above-described practice has resulted in various end users having to stock an inordinately large number of sign holders in various sizes and with various bases for the multitude of display environments, many of which cannot be predicted in advance.

A second drawback which is the proximate result of the use of presently available sign holder systems is that once a single element of the holder system breaks or in some way becomes unavailable for use, the entire frame holder would have to be discarded. Many times the weld maintaining the support base to the frame stem would crack. When this happens, the frame section of the structure, although remaining perfectly adequate for continued use, must be thrown away together with the remaining portion of the sign holder. In the alternative, the end user could have the stem re-welded to the same or a new support base, but the costs involved in doing so often times are not justified by the total cost of a new display unit.

It is thus an object of the present invention to provide a sign holder system which eliminates the drawbacks presented above.

It is yet another object of the present invention to present a sign holder system which is available to the end user in kit form whereby the various parts are interchangeable so that common pieces of each system can be integrated with other pieces of the kit to enable one to achieve enhanced flexibility in the use of a frame holder in a number of dissimilar environments.

These and further objects of the present invention will be more fully appreciated when considering the following specification and drawings in which FIGS. 1 through 6 represent various examples of how the component parts of the present sign holder system can be configured, on site, for use in a number of divergent displays.

SUMMARY OF THE INVENTION

In its broadest terms, the present invention comprises a sign holder system having three basic elements. The first element comprises a display frame for accepting, displaying and supporting a sign in a chosen orientation. The display frame comprises complementary left and right frame halves, each characterized as possessing a border with a central portion through which the sign to be displayed is visible. The borders in turn possess male and female complementary halves possing means for joining of the frame halves for accepting and supporting the sign.

As a second element, means are provided for connecting the display frame to a support structure. The connection means comprises an adaptor characterized as possessing a connecting region which is to be located between the frame halves. The region further possesses areas which engage the inner surface of said frame halves for securing the adaptor in a fixed position. The adaptor can be changed from position-to-position between the frame halves for changing the orientation of the frame at will, such as changing from a horizontal to vertical orientation, for example.

Lastly, the adaptor is intended to be connected to support means. The support means can be one of a number of configurations which depend entirely upon the end use to which the sign holder system is to be applied.

DETAILED DESCRIPTION OF THE INVENTION

Figure 2A:
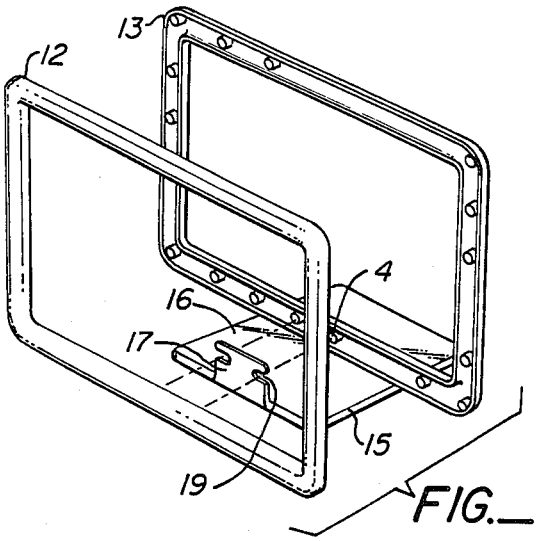

Turning to FIG. 1A, frame halves 1 and 2 are shown in a non-engaged orientation so that female snap-fit connectors 14 can be shown. Although the complementary male connectors are not depicted, they in their preferred embodiment simply comprise pin-like elements molded within frame half 2 for insertion within elements 14.

Prior to connecting halves 1 and 2, the end user decides upon the type of sign holder system intended. This governs the configuration of adaptor 5 which is chosen. In the case of FIG. 1A, adaptor 5 is selected with indents 18 and threaded section 6. It should be noted, however, that in practicing the present invention, any means is contemplated for securing the adapter between the frame halves such as by indents, holes and frictional engagement. In this instance, adaptor fits between two of the snap-fit connectors at indents 18 providing a secure and rigid connecting means. The threaded element 6 can be used to connect assembled frame 3 to stem 8 via internal female threads (not shown) within the distal end of said stem 8. As a cosmetic feature, stem cap 7 can be used to enhance the connection.

Stem 8 can then be telescopically engaged with a smaller diameter stem 9 to provide a height adjustable sign holder system. As an alternative, stem 8 could connect directly to counter base 10 if the end user so desires. Incidental to the practice of the present invention is that the various component parts recited above are capable of quick assembly-disassembly, allowing the end user great flexibility in fabricating sign holder systems on site. For example, counter base 10 can easily be unscrewed from stem 9 and end/dump display stand 11 put in its place.

Figure 2B:
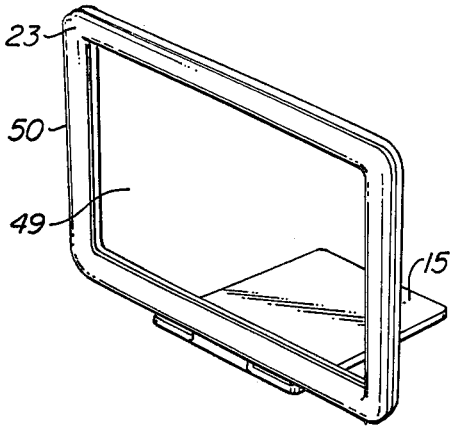

Turning to FIG. 2A, yet another embodiment of the present invention is illustrated. In this case, the adaptor 15 is shown whereby connecting region 7 having indents 19 for engagement with connectors 4 is disposed substantially perpendicularly to flat section 16 providing an easel display unit. In its assembled form, as depicted in FIG. 2B, frame 50 bordering sign display area 49 is shown being supported by easel display base 15. It should be noted that frame elements 12 and 13 can be identical to elements 1 and 2 depicted in FIG. 1A, while an entirely different sign holder system is provided in this second embodiment.

Figure 3A:
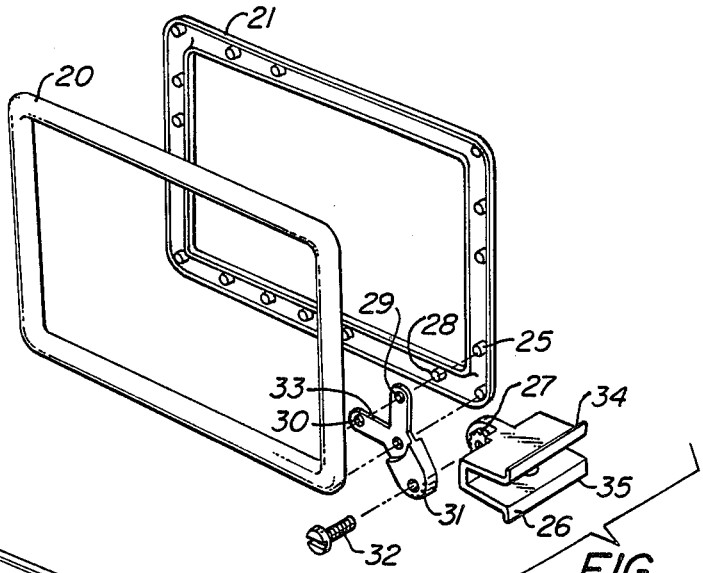
Figure 3B:
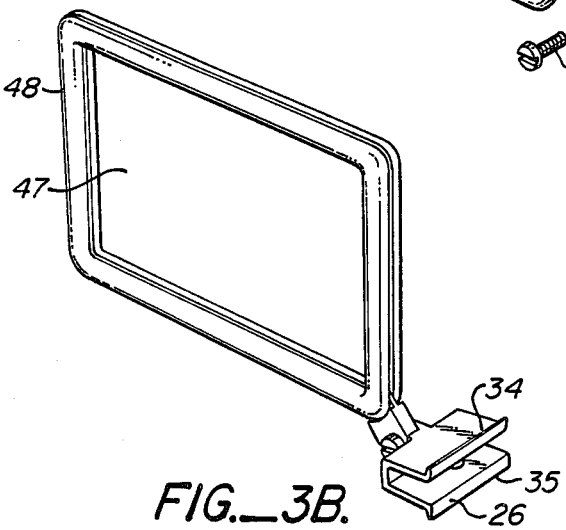

Turning to yet another embodiment of the present invention, reference is made to FIGS. 3A and 3B wherein display frame halves 20 and 21 are shown to secure flattened portion 33 of adaptor 30. The composite halves join to form unitary display frame 48 having an open or windowed portion 47 for displaying sign information (not shown).

Adaptor 30 includes within flattened portion 33 indents 29 which are intended to engage snap-fit connectors 28 which results in fixedly securing the adaptor in a preselected orientation. Adaptor 30, in the embodiment shown in FIGS. 3A and 3B, is intended to be adjustably connected to support means 26 which, because of its outwardly facing lips 34 and 35 is intended to support the sign holder system within a tag molding channel, commonly used in grocery store environments. As illustrative of the flexibility of such a configuration, tooth region 31 is shown engageable with complementary toothed region 27 of support means 26, said regions being lockedly adjustable by means of threaded screw 32. The display frame 48 is capable of being pivotally adjustable about threaded screw 32 by loosening said screw and turning one of the threaded regions with respect to the other, noting that once the proper orientation has been achieved, threaded screw 32 can be re-tightened forming yet another locking engagement. Such flexibility is important for many times along a display the various lengths of molding can be pitched at differing angles or bent requiring the display frame itself to be capable of compensating to provide a straight appealing appearance.

Figure 4A:
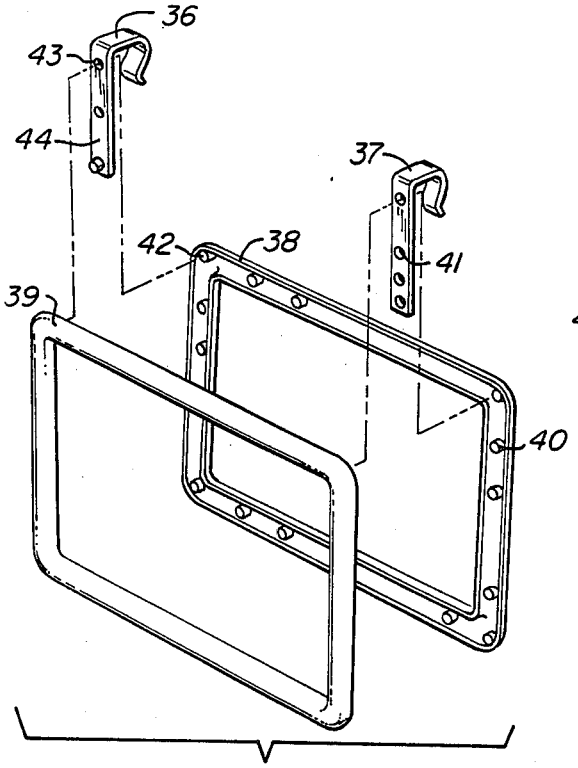
Figure 4B:
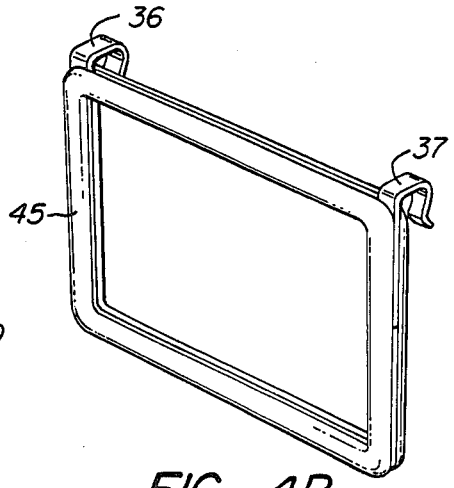

Still a further embodiment of the present invention is disclosed in FIGS. 4A and 4B in which adaptors 36 and 37 are shown in the form of hooks. In this embodiment, connecting region 44 fits between display frame halves 38 and 39 while indents 41 and 43 are shown engaging snap-fit connectors 40 and 42 respectively. Once the display frame halves are joined forming composite frame 45, hooks 36 and 37 are securedly and fixedly attached to the frame at its complementary corners as shown in FIG. 4B. Although not shown, the means for supporting the frame 45 in this embodiment can simply be, for example, a wire basket, the contents of which being advertised by a sign held within frame 45. Alternatively, by repositioning hook members 36 and 37 by, for example, vertically raising the hooks to engage different indents 43 and 41 with the snap fit connectors 40 and 42, the same parts can be used to provide a frame supportable by a canopy such as those shielding a typical fluorescent light fixture found in produce sections of supermarkets.

Figure 5B:
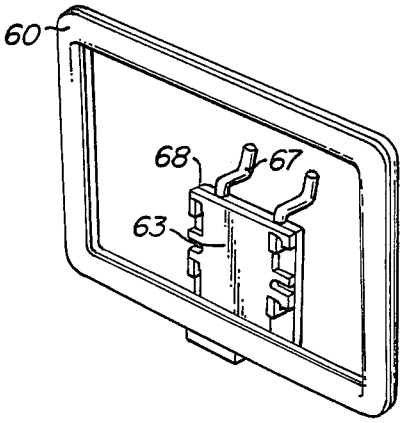
Figure 5A:
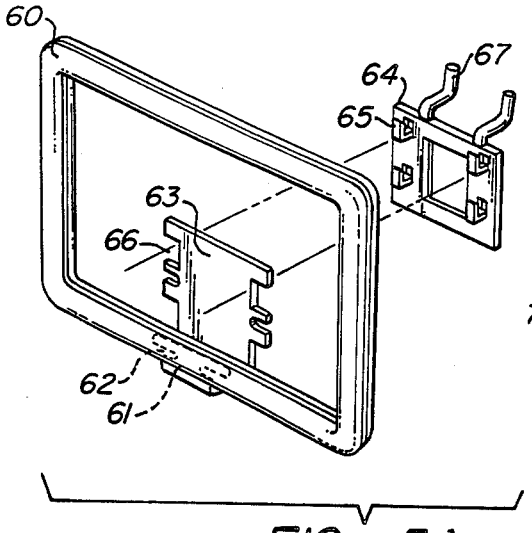
Figure 5C:
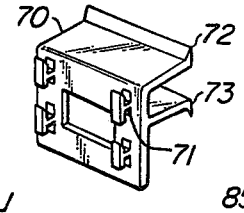

Yet another embodiment of the present invention is depicted in FIGS. 5A and 5B. As illustrated, adaptor 63 is illustrated as possessing connecting region 61 configured to fit between the frame halves which have been joined, forming composite frame 60. Connecting portion 61 possesses indents 62 which engage snap-fit connectors in much the same way as was illustrated by element 5 of FIG. 1A. The remaining portion of the adaptor consists of flattened region 61 in which indents 66 are provided. This configuration can be used in a number of varied environments. For example, backing 63 can support frame 60 as a wall mounting bracket. Alternatively, indents 66 can engage protrusion 65 in pegboard attachment 64 resulting in composite 68 (FIG. 5B). Upwardly facing projection 67 can then fit within pegboard openings (not shown) for support of the display frame.

Figure 5D:
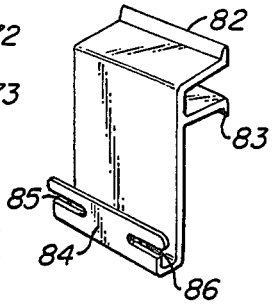

Yet another alternative embodiment employing basically the same adaptor is to engage flattened surface 63 with projections 71 which enable the frame to be supported by a channel within a price tag molding. In this instance, support means 70 is shown to possess channel lips 72 and 73 for engagement with corresponding support tracks as noted above. Although not illustrated, it is noted that support means 70 is capable of being inverted 180° upon engagement with connection region 63. In an illustrated orientation, the lower edge of the frame would reside several inches below the molding while upon inversion of the support, the lower edge would be flush to the molding. Alternatively, the frame could be attached to a length of price tag molding by the unitary adapter shown in FIG. 5D. In this embodiment, lips 82 and 83 are connected in a single piece to connecting region 84 containing indents 85 and 86.

Figure 6A:
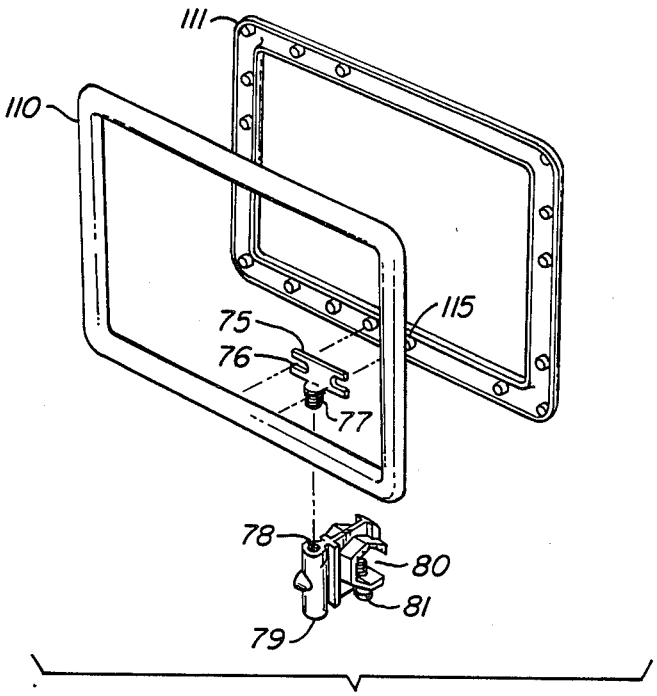
Figure 6B:
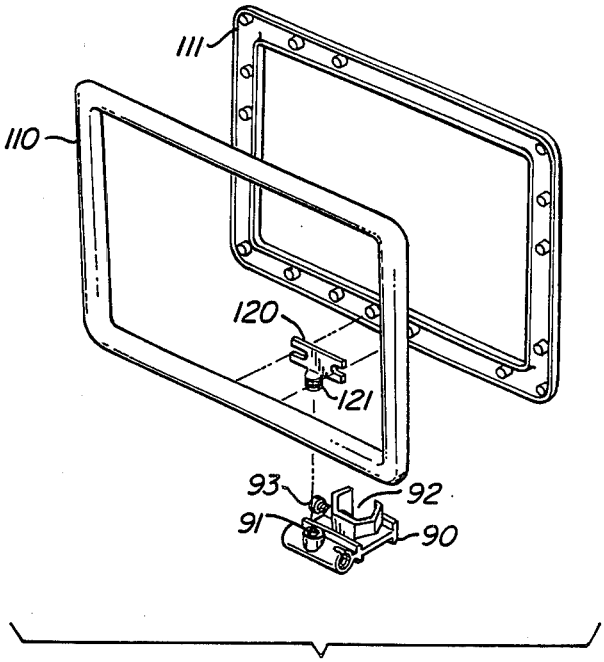

As a final embodiment, reference is made to FIGS. 6A and 6B which illustrate the use of adaptor 75 which, as in the previous embodiments, is intended to fit between frame halves 110 and 111. In doing so, indents 76 are intended to engage snap-fit connectors 115 for securedly maintaining the adaptor in position. In this embodiment, threaded male connector 77 is configured to engage threaded receiving member 78, which is in turn made part of tubing frame bracket 79.

As shown, tubing frame bracket 79 is configured to possess opening 80 through which appropriately dimensioned tubing is intended to slide. Once proper positioning of the display frame is selected, set screw 81 is tightened to maintain the frame securedly in the chosen position. As illustrated, tubing frame bracket 79 is configured to accept substantially horizontally positioned tubing.

As an alternative to the embodiment shown in FIG. 6A, FIG. 6B illustrates a tubing frame attachment for substantially vertically positioned tubing. In this embodiment, adaptor 120 possessing threaded male connector 121 is intended to be receivably connected to threaded receiving port 91 of tubing frame bracket 90 which can be the previously described bracket 79 which has been rotated 90°. Opening 92 is intended to accept properly dimensioned tubing which, upon engagement, can be securedly and fixedly attached by tightening threaded set screw 93.

From all of the various embodiments described above, it can be readily visualized that the present invention is capable of providing great flexibility in enabling a merchandiser to configure various sign holder systems for a number of diverse applications while maintaining a relatively small stock of frame piece elements.

Prior to the present invention, the end user would have been forced to stock a multitude of various sign holders in duplicating the configuration depicted in the appended drawings. For example, it is noted that in each embodiment shown herein, the horizontally disposed rectangular frame halves could be rotated 90° to present a vertical orientation. Such flexibility was impossible to achieve prior to the present invention. Similarly, frame halves of differing size and shape could be readily substituted while reusing pre-existing adapters and support means.

I claim:

1. A sign holder system comprising:

(a) a display frame for accepting, displaying and supporting a sign in a chosen orientation, said frame comprising a left frame half and a right frame half, (b) each frame half possessing an inner face and an outer face and a border through which the sign to be displayed is visible, (c) means for releasably joining the frame halves, (d) an adaptor comprising a flattened section and an outwardly extending section, the flattened section of said adaptor being secured between said frame halves when said frame halves are releasably joined, and (e) support means secured to said outwardly projecting section of said adaptor for retaining the system in a stable condition.

* * * * *